United States Patent [19]

Hase

[11] 4,206,434

[45] Jun. 3, 1980

[54] REGULATING TRANSFORMER WITH MAGNETIC SHUNT

[76] Inventor: Alfred M. Hase, 6 Manorwood Rd., Scarborough, Ontario, Canada

[21] Appl. No.: 937,853

[22] Filed: Aug. 29, 1978

[51] Int. Cl.[2] ..... H01F 21/08

[52] U.S. Cl. ..... 336/5; 323/56; 336/165; 336/172; 336/184; 336/215

[58] Field of Search ..... 336/155, 172, 160, 165, 336/178, 215, 214, 5, 10, 12, 184, 180; 323/56, 89 C, 89 AG

[56] References Cited

U.S. PATENT DOCUMENTS

| | | | |
|---|---|---|---|
| 1,376,978 | 5/1921 | Stoekle | 336/160 X |
| 2,245,192 | 6/1941 | Gugel | 323/56 X |
| 2,500,189 | 3/1950 | Landis | 336/165 |
| 2,802,981 | 8/1957 | Hobart et al. | 336/165 X |
| 2,864,993 | 12/1958 | Schober | 336/215 X |
| 3,360,753 | 12/1967 | Wroblewski | 336/178 X |
| 3,622,868 | 11/1971 | Todt | 336/155 X |

FOREIGN PATENT DOCUMENTS

| | | | |
|---|---|---|---|
| 998502 | 1/1952 | France | 323/56 |
| 1008194 | 5/1952 | France | 336/160 |
| 1350494 | 12/1963 | France | 336/160 |
| 409217 | 2/1945 | Italy | 336/155 |
| 540456 | 10/1941 | United Kingdom | 336/155 |

*Primary Examiner*—Thomas J. Kozma
*Attorney, Agent, or Firm*—Donald E. Hewson

[57] ABSTRACT

A regulating power transformer has a DC-shunt control arranged so that coupling between the primary and secondary windings of the transformer over substantially the entire range from 5% to 95% of rated line input may be achieved, with low harmonic component and low voltage distortion in the output. A DC-shunt, having a cross-section at least equal to any single path AC magnetic flux core leg is interposed between primary and secondary windings placed on the core legs, with an air gap between each end of the shunt member where it is contiguous to a core leg, and a DC control winding is arranged through at least one window formed in the shunt member. The AC reluctance through the shunt member and the air gaps at each end is less than the AC reluctance in the principal magnetic path between the primary and secondary windings, so that when there is zero DC current in the DC control winding, there is substantially no coupling between the primary and secondary windings, with substantially all of the magnetic flux established by the primary winding being shunted through the shunt member.

13 Claims, 9 Drawing Figures

REGULATING TRANSFORMER WITH MAGNETIC SHUNT

BACKGROUND OF THE INVENTION

This invention relates to regulating transformers having magnetic shunt members, and particularly to a regulating power transformer having a DC controlled shunt member, where the shunt member is interposed between the primary and secondary windings placed on the core in which the principal AC magnetic flux path can be established.

BACKGROUND OF THE INVENTION

There have been AC or DC-shunt controlled regulating transformers used in the past, having limited regulating range and with quite coarse load and line regulation, for such purposes as welding transformers and the like. Such transformers have had inherent disadvantages including high leakage flux between primary and secondary windings, and therefore a low power factor; rather poor primary to secondary coupling; fairly low efficiency, in the range of 70% to 90%, the remainder being expended in eddy currents, magnetic core heating, etc.; and high output waveform distortion. All of these disadvantages have come, in welding transformers and the like, as a result of the arrangement and construction of the cores and coils placed upon them.

There have also been a number of combination saturable reactor, magnetic amplifier/transformer regulating systems; but such systems have had one particular inherent disadvantage which is that there is a high waveform and harmonic distortion in the output, which may be reflected back into the AC line on the input side of the transformer. Such arrangements also have generally suffered from a slower response time because they are phase angle controlled; and, of course, such two component systems have been bulky and costly to manufacture.

Of particular interest in the prior art regulating power transformers have been devices shown in U.S. Pat. No. 3,622,868 in the name of Joachim H. Todt, issued Nov. 23, 1971; and U.S. Pat. No. 3,686,561 in the name of Robert J. Spreadbury, issued Aug. 22, 1972. The Todt patent teaches a regulating power transformer where primary and secondary windings may be separated from one another on the centre leg of an E-type laminated magnetic core, which is formed with two similar E-type lamination stacks separated by an I-type lamination stack having DC control windings placed thereover. Care must be taken, in such an arrangement, that the control coils are not wound having opposite DC polarity, otherwise they would cancel. Moreover, the cross-section of the magnetic shunt path is taught to be substantially reduced from the cross-section of the principal flux path, giving rise to a limited control range and AC saturation waveform distortion; and as well, the butt joints at either side of the magnetic shunt result in increased AC core losses, heating, reduced primary to singular coupling at no load conditions, and increased audible noise from the core.

Spreadbury shows a parametric regulating and filtering transformer which has a non-magnetic gap or gaps in the output region of the magnetic coil thereof. The purpose of this transformer is not to produce an undistorted output waveform, but rather a particular desired waveform. However, a tank circuit is formed with a capacitor being connected to or associated with the output winding, but the Spreadbury device is primarily a low efficiency device having high energy wastage.

The present invention overcomes the difficulties of the prior art by providing a DC shunt controlled transformer which may have any one of a number of different core configurations—such as what might be conventionally referred to as UI, or double-UI configuration having a basic U-core limination circuit; an EI-lamination circuit, which presents an EE or EIE configuration; multi-leg, multi-phase configurations, etc. In any event, a DC-shunt member (or members) is provided having a DC winding formed therein—and not around the shunt member—by having at least one window formed therein through which the DC control winding is placed. In the preferred embodiments, there are two windows formed in the shunt member—or each shunt member, if more than one is used—and the primary and secondary windings placed on the core legs of the laminated core through which the principal AC magnetic flux path can be established are physically separated one from another and have the shunt member or members interposed between them. The cross-sectional area of the shunt member or members is at least as great as the cross-sectional area of a core leg of the principal magnetic path core where a single magnetic flux path may be established which would provide coupling between primary and secondary windings formed on that core leg or at least in the magnetic flux loop.

In providing for DC-shunt control of the sort discussed above, it has been found that an air gap must be placed at each end of a shunt member where it is contiguous to a core leg through which an AC magnetic flux path can be established, for maximum speed of response, minimal output waveform distortion and reflected harmonics in the input side of the transformer, and high efficiency operation with very low core losses in heating or audible noise generation.

Thus, this invention provides a regulating power transformer which has at least one primary winding and at least one secondary winding which are separated one from the other, where there is at least one AC magnetic path through which an AC flux coupling said at least one primary winding to said at least one secondary winding can be established. There is at least one shunt member interposed between the primary and secondary windings, and placed between two portions of the AC magnetic path with an air gap at each end of the shunt member between the ends thereof and the respective contiguous portions of the AC magnetic path. The present invention provides that at least one DC control winding is arranged with the shunt member so as to pass through at least one window formed therein. Further, the present invention is such that the sum of the AC reluctance of the shunt member and of the AC reluctances of the air gaps at the ends of the shunt member is less than the AC reluctance of that portion of the principal AC magnetic path on which there has been placed one or more secondary windings; so that, when there is zero current in the DC control winding, there is substantially zero coupling between the primary and secondary windings, substantially all of the AC flux which is established due to the presence of an alternating current on the primary windings being shunted through said lower reluctance shunt member and air gaps rather than going to couple the primary winding magnetically to the secondary winding.

The present invention provides a variety of embodiments whereby the principles of the invention may be realized in single, three-phase or multi-phase operation, with U-core or E-core laminated stacks, and with conventional core laminating and coil winding techniques; providing that the DC control winding is placed and arranged with the shunt member or members so as to pass through at least one window formed therein.

BRIEF SUMMARY OF THE INVENTION

It is a principal object of this invention to provide a regulating power transformer which has a wide control range, high efficiency and low output waveform distortion or harmonic content, using conventional transformer assembly techniques, but where a shunt member is interposed between physically separated primary and secondary windings and acts to substantially preclude primary to secondary coil coupling when there is zero DC control current.

A further object of this invention is to provide a regulating power transformer as referred to above, in a variety of embodiments, in single-phase, three-phase or multi-phase circuit arrangements.

Yet another object of this invention is to provide a regulating power transformer which has a fast response time as compared to phase angle controlled magnetic regulating power transformer/saturable reactor or magnetic amplifier combination devices.

A still further object of this invention is to provide a regulating power transformer having DC-shunt control where the DC control current waveform has substantially no influence on the harmonic characteristic of the input and output current and voltage waveforms; thereby providing for pulse width modulated DC control.

Yet a further object of this invention is to provide a regulating power transformer as spoken of above, whereby automatic power factor correction is accommodated.

BRIEF DESCRIPTION OF THE DRAWINGS

These and other features, objects and advantages of the present invention are discussed in greater detail hereafter, in association with the accompanying drawings, in which.

DESCRIPTION OF THE PREFERRED EMBODIMENTS

As stated above, the regulating power transformer of the present invention is substantially a pulse-width modulated DC control device having a DC-shunt member interposed between primary and secondary AC windings, so as to provide substantially linear amplitude modulation over a wide range of operating values. The principles of the present invention are described hereafter, with particular reference to FIGS. 1 and 5.

Figure 1:
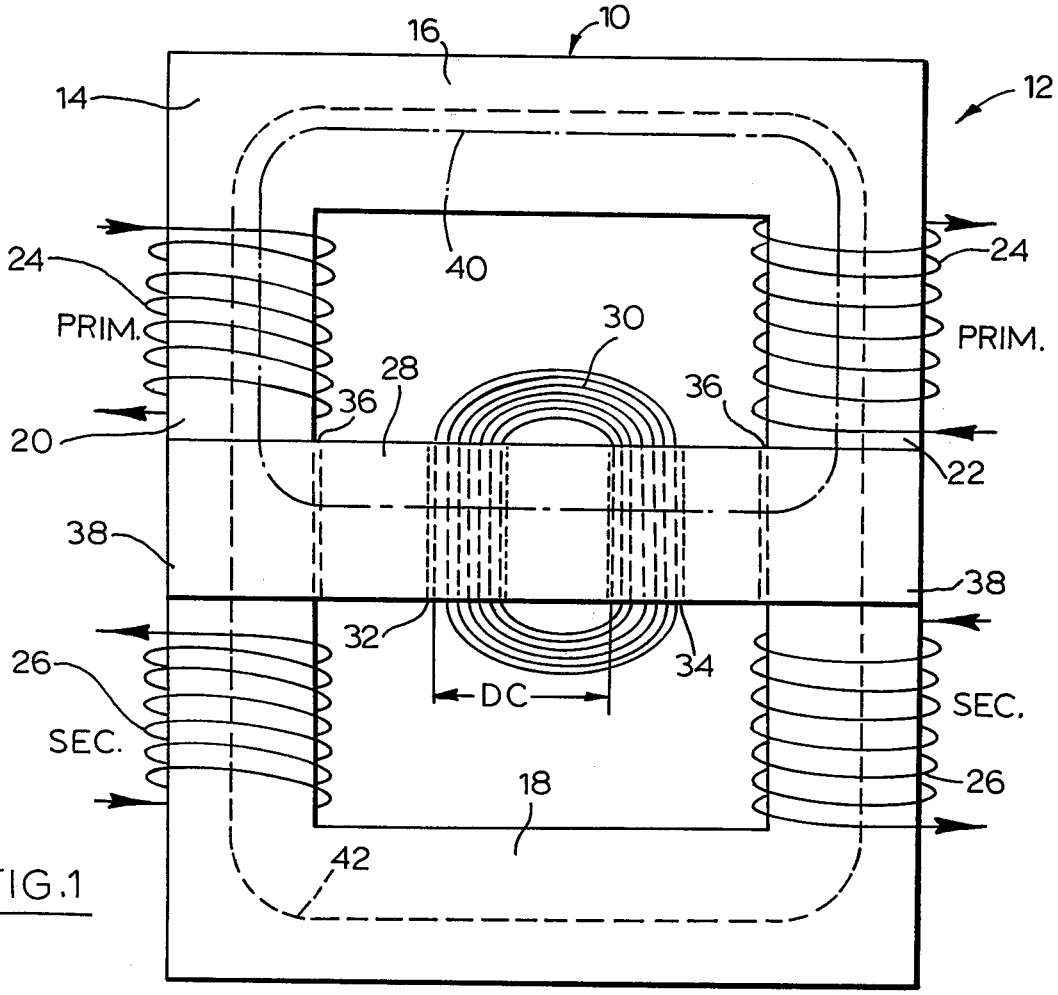
FIG. 1 is a schematic sketch showing a basic regulating power transformer arrangement according to the present invention.

There is shown in FIG. 1 a basic U-core—or UI-core—lamination stack 12 of a regulating power transformer 10 according to the present invention. The core arrangement is such that it comprises a stack of laminations 14 having generally rectangular configuration in the present instance, and consisting of four portions 16, 18, 20 and 22. For ease of discussion, those portions 20 and 22 may be considered to be core legs, and on each of the core legs 20 and 22 there is placed a primary winding 24 and a secondary winding 26. Of course, a single primary winding 24 might be placed on the portion 16, and similarly a single secondary winding 26 might be placed on the portion 18. The windings 24 and 26 are placed over the core legs 20 and 22 according to known techniques.

A shunt member 28 is placed between the core legs 20 and 22; that is, the shunt member 28 is interposed between the primary windings 24 and the secondary windings 26. A DC control winding 30 is arranged with the shunt member 28, and in the embodiment of FIG. 1, the DC control winding 30 is arranged to pass through two windows 32 and 34 which are formed in the shunt member 28. An air gap 36 is provided at each end of the shunt member 28 where it is contiguous to the sides of the respective core legs 20 and 22. In a preferred embodiment, as discussed hereafter, a portion 38 of the shunt member 28 may extend past each of the core legs 20 and 22.

Figure 5:
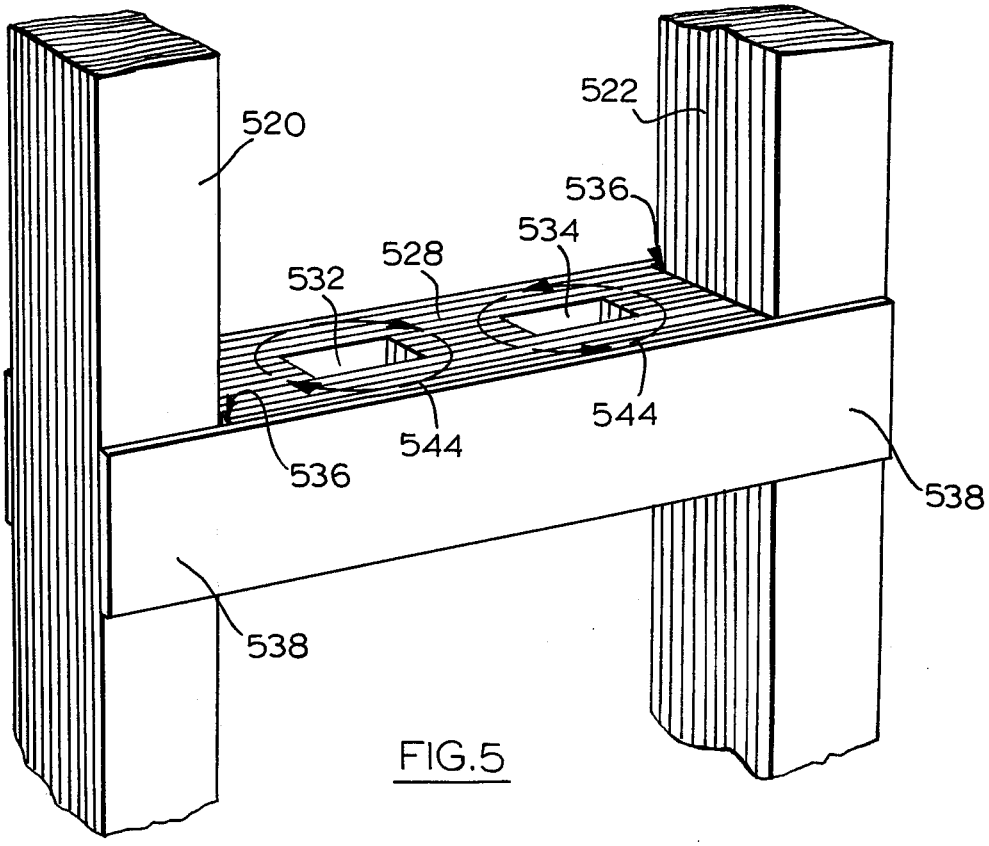
FIG. 5 is a partial perspective view showing certain features of the relationship of a shunt member to AC magnetic path core legs, in keeping with the invention.

Referring briefly to FIG. 5, a pair of shunt legs 520 and 522 are shown, with a shunt member 528 having windows 532 and 534 formed therein. It can be seen that there is an air gap 536 at the ends of the shunt member 528 contiguous to the inside edges of the respective core legs 520 and 522. A portion 538 of the shunt member 528 extends past the sides of the core legs 520 and 522.

It has been stated that, according to the present invention, the sum of the AC reluctance of the shunt member 28 (or 528) and the air gaps 36 (or 536) at the ends thereof, is less than the AC reluctance of that portion of the AC magnetic path which is formed by the lamination stack 12 on which the secondary windings 26 are placed. That is, the AC reluctance of the shunt member 28 and the air gaps 36 is less than the AC reluctance of the lower portions of the core legs 20 and 22 and the portion 18 between them, on which the secondary winding or windings 26 have been placed. It can be seen, therefore, that when there is an alternating current voltage impressed upon the primary winding or windings 24, and there is no DC voltage impressed upon the DC control winding 30, the AC magnetic flux which is established because of the AC voltage in the primary windings is shunted through the air gaps 36 and the shunt member 28, and there is therefore no coupling between the primary windings 24 and the secondary windings 26. The path of the AC magnetic flux through the upper portions of the core legs 20 and 22 and the portion 16 of the lamination stack 12 between them, at no DC current condition in the DC control winding 30, is shown by chain line 40.

When, on the other hand, there is maximum DC control current in the DC control winding 30, there will be substantially no AC flux passing through the shunt member 28 and the air gaps 36, so that there is maximum coupling between the primary windings 24 and the secondary windings 26. The path of the AC magnetic flux at maximum DC control current conditions in the DC control winding 30 is shown by the dotted line 42.

It can be seen, from references to FIGS. 1 and 5, that the AC magnetic flux path, when any quantity thereof is being shunted away from coupling the primary windings 24 to the secondary windings 26, must pass through the shunt member 28 (528) and the air gaps 36 (536). Because it is desired to have substantially zero coupling between the primary and secondary windings at no DC current conditions in the DC control winding 30, the present invention provides that the cross-sectional area of the shunt member 28 (528) shall be at least equal to the cross-sectional area of a single path core leg in the principal AC magnetic circuit—as discussed in greater detail hereafter—taken at a place where the AC magnetic flux can be established so as to provide coupling between the primary windings 24 and the secondary windings 26. Such a place is, of course, in that portion of the core legs 20 and 22, for example, opposite the ends of the shunt member 28—or at least that portion of the shunt member 28 which lies between the core legs 20 (520) and 22 (522). Of course, in general, the cross-sectional area of the core legs is substantially constant throughout because of the laminated structure thereof; but as discussed hereafter with reference to FIGS. 6 and 8, it will be seen that the cross-sectional area of single path magnetic flux core legs may be less than the cross-sectional area of double path magnetic flux core legs.

In any event, because the cross-sectional area of the shunt member 28 (528) is at least as great as the cross-sectional area of the contiguous portion of the core legs 20 (520) or 22 (522), the cross-sectional area of the shunt member 28 (528) may, indeed, be greater. Indeed, the shunt member 528 is shown in FIG. 5 as being greater in thickness and of substantially equal width to the core legs 520 and 522; and thus there is a portion 538 of the shunt member 528 which overlies the sides of the core legs 520 and 522.

Of greater significance, however, is the fact that in the embodiment thus far described with reference to FIGS. 1 and 5, the DC control winding 30 is arranged with the shunt member so that it is, in effect, within the shunt member; by being placed in the windows 32 (532) and 34 (534), in contradistinction to the normal DC control winding arrangement where the control coil is placed over a shunt member when such is used. In the embodiment shown in FIGS. 1 and 5, the axes of the windows formed in the shunt member are substantially parallel to the longitudinal axes of the core legs. It will be seen that a DC flux is formed in the shunt member 28 or 528 in the presence of a DC current in the DC control winding 30, as shown at arrows 544 in FIG. 5. The effective portions of the DC flux in the shunt member are substantially at 90° to whatever AC flux there may be within the core member. The air gaps 36 (536) serve substantially to preclude any effect of the DC flux which may be established in the flux member from affecting the core legs. Thus, there is substantially no influence of the DC control current waveform on the manner in which the secondary windings are coupled to the primary windings, and thus there is substantially no influence of the DC control current waveform in respect of the input or output current and voltage waveform characteristics. This factor thereby provides for pulse-width modulation control of the regulating power transformer; and the pulse-width modulation DC control, in turn, assures low heat losses in the shunt member, and thereby higher efficiency.

It will be seen that, at maximum output conditions of the regulating power transformer—maximum DC control current—there is good coupling between the primary and secondary windings; and there are no discontinuities interposed in the flux path coupling the primary to secondary windings. However, as stated, at zero output conditions—zero control current in the DC control winding 30—there is substantially no coupling between the primary and the secondary windings because of the greater AC reluctance on the secondary side of the shunt member than through the air gaps and shunt member.

It can thus be seen that a wide control range may be achieved, in the order of from 5% to 95% of rated line input, over the range of zero to maximum DC control current in the DC control winding 30.

Likewise, it becomes obvious that the circuit provides a high efficiency operating device with low energy losses, because there are very low core losses either due to heating or audible noise generation, both with respect to the AC core and the DC-shunt member. Therefore, if sinusoidal current and voltage waveforms are impressed on the primary windings 24, it follows that substantially sinusoidal current and voltage waveforms will appear at the output of the secondary windings 26 when there is coupling between the primary windings 24 and secondary windings 26. Thus, there is a low harmonic content in the output, low waveform distortion, and likewise a low reflected harmonic from the secondary windings 26 to the primary windings 24 through the AC magnetic flux path.

As will be discussed hereafter, the present invention is easily applicable to single-phase, three-phase or multi-phase operation. Likewise, transformers according to the present invention are particularly applicable to single-phase, three-phase or multi-phase rectification because of the high transformer impedance which reduces peak currents, increases the conduction time in any winding, and reduces or eliminates the need for filter chokes.

It has been stated that the DC control winding 30 is arranged with the DC-shunt member 28 so as to be, in effect, within the shunt member; and in any event, so that the effective DC flux established in the flux member is at right angles to any AC magnetic flux which may be being shunted by the shunt member. Alternative arrangements for the DC control winding 30 are shown in FIGS. 2, 3 and 4; and each of the alternative arrangements provides for a DC flux to be established at right angles to any AC flux being shunted in the shunt member, and more importantly the alternative arrangements provide for the DC control winding to be arranged with the shunt members so as to pass through at least one window formed therein.

Figure 2:
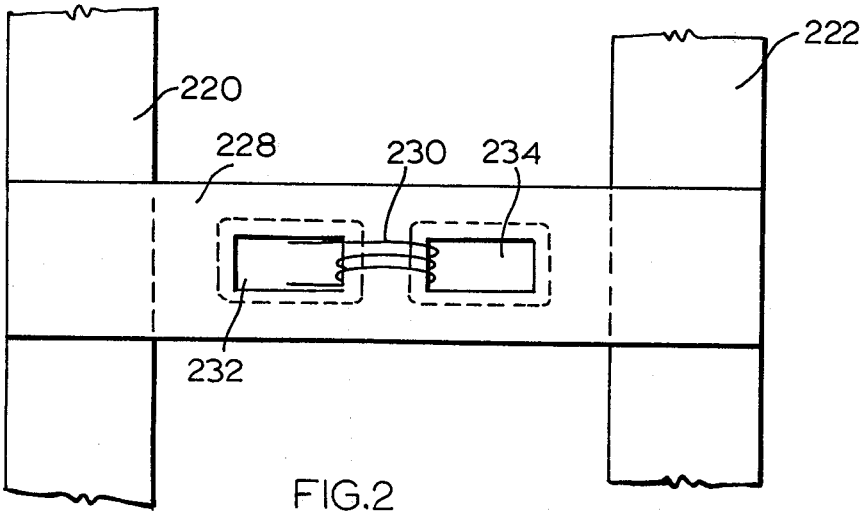
FIGS. 2, 3 and 4 illustrate various alternative arrangements for the DC control winding associated with and placed in a shunt member in accordance with this invention.

Thus, in the alternative arrangement of FIG. 2, the shunt member 228 is shown between core legs 220 and 222, with the DC winding 230 passing through windows 232 and 234 formed therein. This arrangement is much like the arrangement shown in FIGS. 1 and 5, except that the windows and the DC control winding are perpendicular to the previous arrangement, with the axes of the windows being substantially perpendicular to the longitudinal axes of the core legs 220 and 222.

Figure 3:
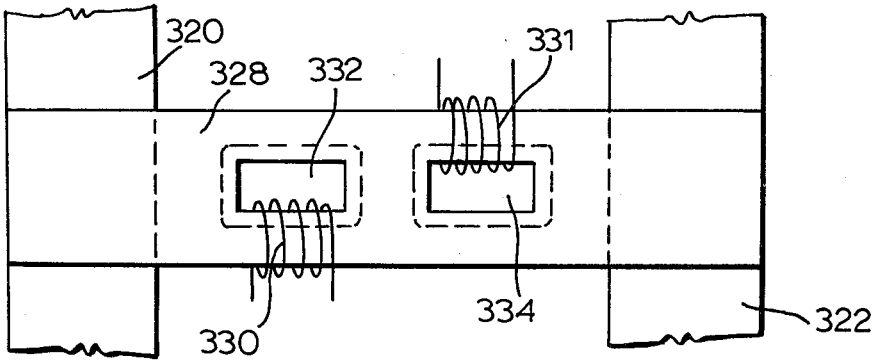

In the embodiment of FIG. 3, a split DC control winding having portions 330 and 331 is arranged with the shunt member 328. The windows 332 and 334 are formed substantially as windows 232 and 234 as shown in FIG. 2, that is with their axes substantially perpendicular to the longitudinal axes, in this case, of the core legs 320 and 322.

Figure 4:
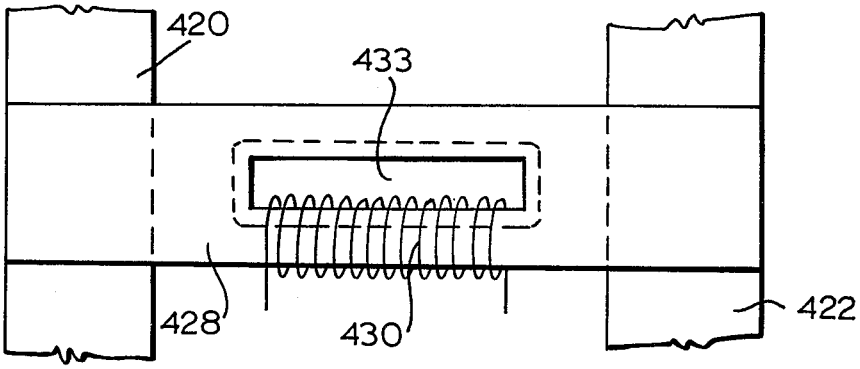

Another alternative DC control winding arrangement is shown in FIG. 4, where a single window 433 is shown in the shunt member 428 placed between the core legs 420 and 422. A single DC control winding 430 passes through the window 433.

In all cases, as mentioned above, a DC flux is established in the presence of DC control current in the DC control winding, which is substantially perpendicular to any AC magnetic flux which may be being shunted by the shunt member.

Figure 6:
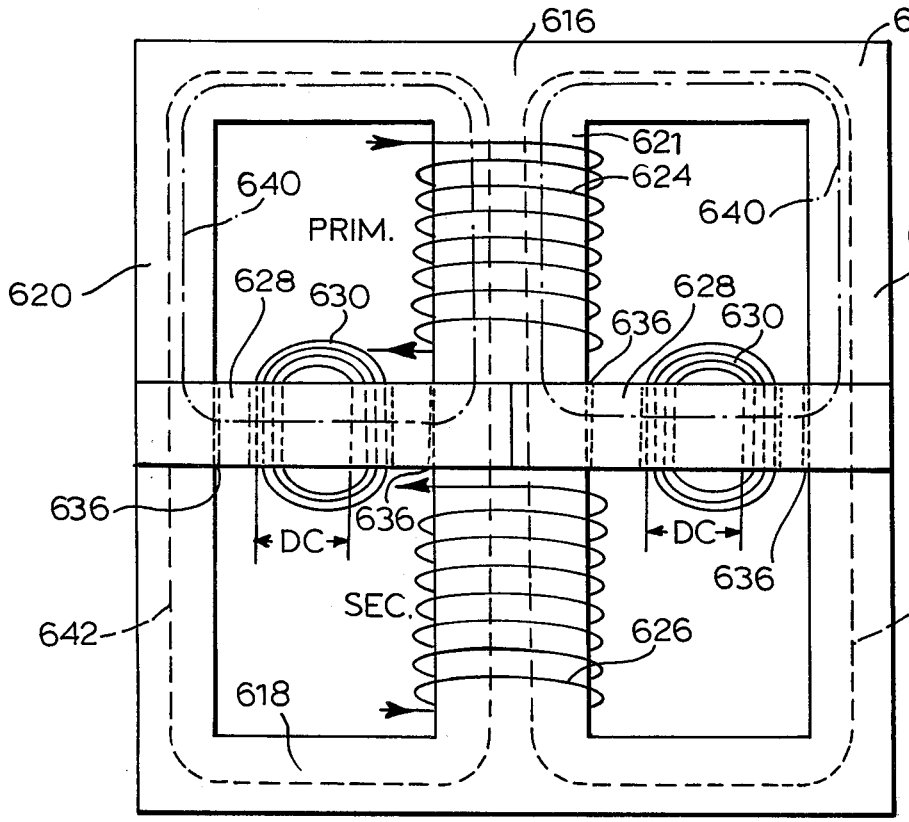
FIG. 6 is a schematic sketch of a different basic arrangement of a regulating power transformer having single phase operation but having a pair of shunt members.

Referring now to FIG. 6, an alternative, three-leg lamination stack 614 is shown having a central core leg 621 and outer core leg 620 and 622; and having upper and lower portions 616 and 618. In this embodiment, there are a pair of shunt members 628 arranged between adjacent pairs of core legs; i.e., there is one shunt member 628 between the core legs 620 and 621, and another shunt member 628 between the core legs 621 and 622. DC control windings 630—which are substantially identical—are arranged in each of the shunt members 628; and alternative placements of the DC control windings 630 may be provided as discussed above, with particular reference to FIGS. 2, 3 and 4.

The shunt members 628 are seen to be in substantially end-to-end arrangement one with the other. As before, the shunt members 628 are interposed between primary and secondary windings which, in this case, are shown to be single windings 624 and 626 respectively placed on the central core leg 621. However, split primary and secondary windings could be placed elsewhere over the principal magnetic flux paths provided by the upper and lower portions of the legs 620, 621 and 622, respectively.

In any event, it is again seen that, in the absence of any DC control current in the DC control winding 630, and when there is an AC voltage impressed on the primary winding 624, the AC magnetic flux which is established is shunted through the end-to-end shunt members 628 as shown by chain lines 640. Likewise, when there is maximum DC control current in the DC control winding 630, there is maximum coupling between the primary winding 624 and the secondary winding 626, with two magnetic flux loops established as shown by dotted lines 642.

It will be seen that the width of the central core leg 621 is contemplated to be greater than the width of either of the outer core legs 620 and 622. There is only a single magnetic flux path in the outer leg 620 and 622 coupling the primary and secondary portions thereof—subject, of course, to the presence and amount of DC current in the DC control windings 630, as discussed above. The cross-sections of the shunt member 628 are each at least as great as the cross-sections of the outer legs 620 and 622, as discussed above. Air gaps 636 are found at each end of each shunt member 628 where they are contiguous to the sides of the respective core legs 620, 621 and 622.

Figure 7:
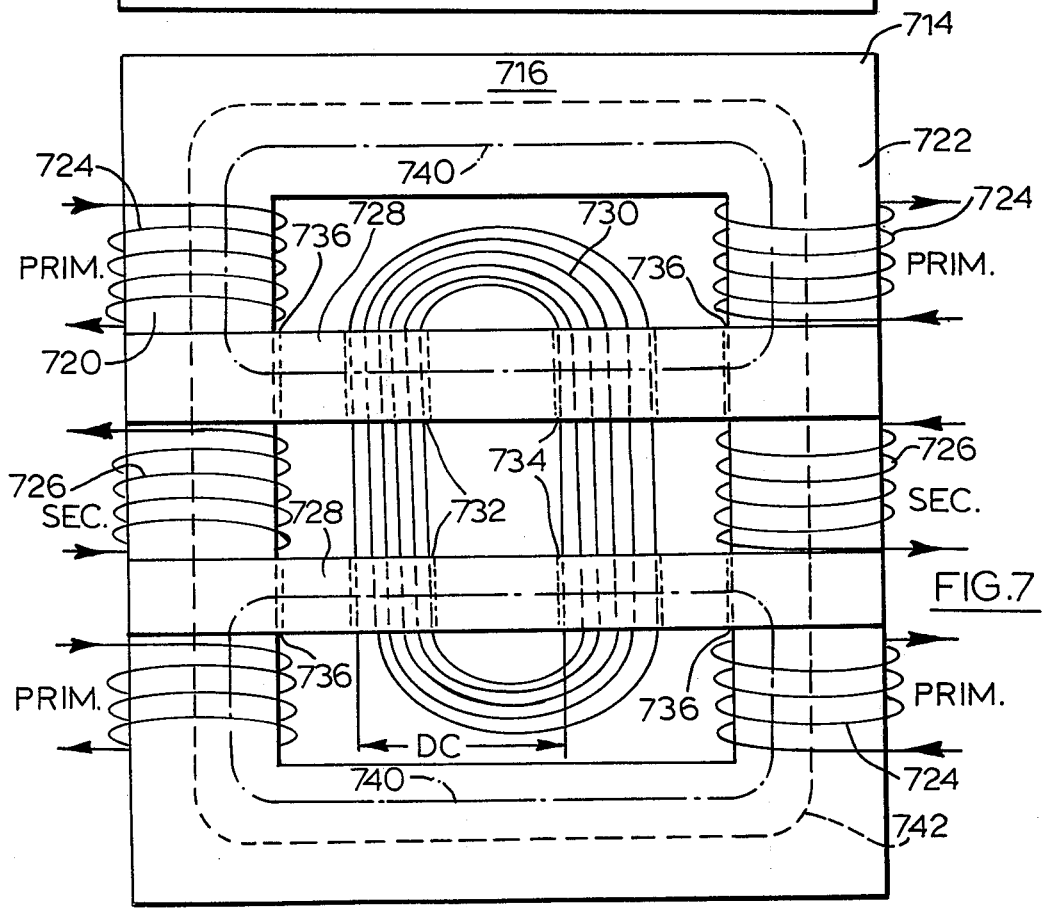
FIG. 7 is a schematic sketch of an improved circuit of the type shown in FIG. 1.

Referring now to FIG. 7, there is shown an alternative embodiment of a basic circuit such as that shown in FIG. 1. However, in the embodiment of FIG. 7, there are a pair of shunt members 728; and there are a pair of split primary windings 724 placed on each of the core legs 720 and 722.

A single DC control winding 730 is shown, arranged through both of the shunt members 728, and passing through windows 732 and 734 formed in those shunt members. Alternatively, two DC control windings 730 might be used, one in each of the shunt members, and the DC control windings could be appropriately series or parallel connected. Likewise, alternative arrangements can be used for the DC control windings, as discussed above with reference to FIGS. 2, 3 and 4.

The primary windings 724 may be series or parallel or series/parallel connected, with proper observation of polarities; and likewise, the split secondary winding 726 may be series or parallel connected.

It will be seen that each of the shunt members 728 is arranged with respect to the primary windings 724 and the secondary windings 726, and between the core legs 720 and 722, so that there is a shunt member 728 interposed between primary windings 724 and secondary windings 726, in all cases, and placed between two portions of the AC magnetic path which can be established so as to couple the primary windings 724 to the secondary windings 726. Once again, at no DC control current conditions, the paths of the established AC flux loops due to the presence of an impressed AC voltage in the primary windings 724 are shown as being shunted through the shunt members 728 at chain lines 740. Similarly, at maximum DC control current in the DC control windings 730, there is maximum coupling between the primary windings 724 and the secondary windings 726, and the path of the AC magnetic flux loop is shown by the dotted line 742.

The cross-sectional areas of the shunt members 728, taken together are at least equal to the cross-sectional areas of each of the core legs 720 and 722.

The embodiment of a regulating power transformer according to this invention, as shown in FIG. 7, is a particularly commercially feasible embodiment because it has a very high primary to secondary coupling efficiency—in the order of 90% to 95%, or better.

Figure 8:
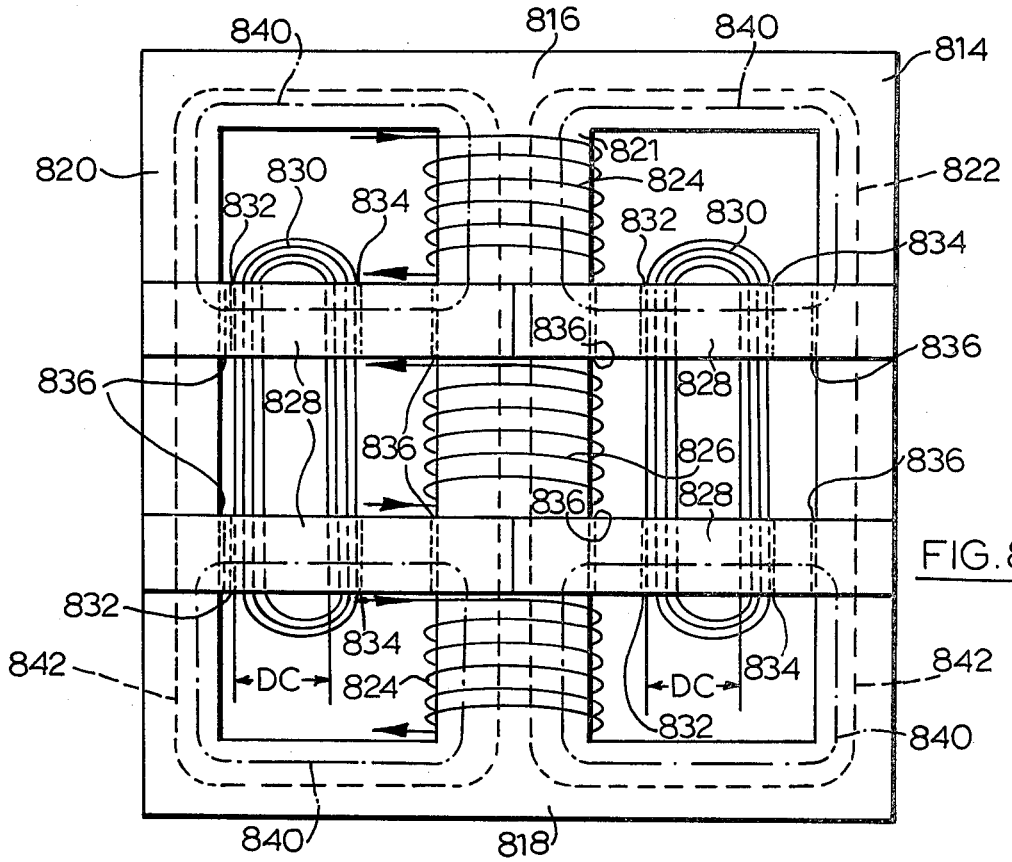
FIG. 8 is a schematic sketch of an improved circuit of the type shown in FIG. 6.

Referring now to the circuit of FIG. 8, it will be seen that this embodiment is substantially derived from the embodiment of FIG. 6 in much the same way that the embodiment of FIG. 7 is derived from the embodiment of FIG. 1. Thus, the lamination stack 814 comprises outer core legs 820 and 822, and central core leg 821, together with upper and lower portions 816 and 818 respectively. Split primary windings 824 are shown being placed on the central core leg 821, together with a secondary winding 826, and pairs of shunt members 828 in end-to-end relationship one with another, in each pair, are shown to be interposed between the primary windings 824 and the secondary windings 826. DC control windings 830 are provided, having been placed in the shunt members 828 through the respective windows 832 and 834; and air gaps 836 are provided at the ends of each of the shunt members 828 in the manner previously discussed.

The relationship of the combined cross-sectional areas of the shunt members 828 to the outer, single flux path, core legs 820 and 822, is the same as discussed above with respect to FIG. 7. Likewise, the relationship of the cross-sectional areas of the outer core legs 820 and 822 with respect to the centre core leg 821 are the same as discussed above with respect to FIG. 6.

At zero DC control current conditions, there are four AC flux path loops established, as shown by chain lines 840. Likewise, in the presence of DC control current within the DC control windings 830, a pair of flux path loops 842 is established, with maximum coupling between the primary windings 824 and the secondary winding 826 occurring at maximum DC control current conditions.

The same advantages, with respect to particular commercial feasibility of the embodiment of FIG. 8, exist as discussed above with respect to FIG. 7.

Figure 9:
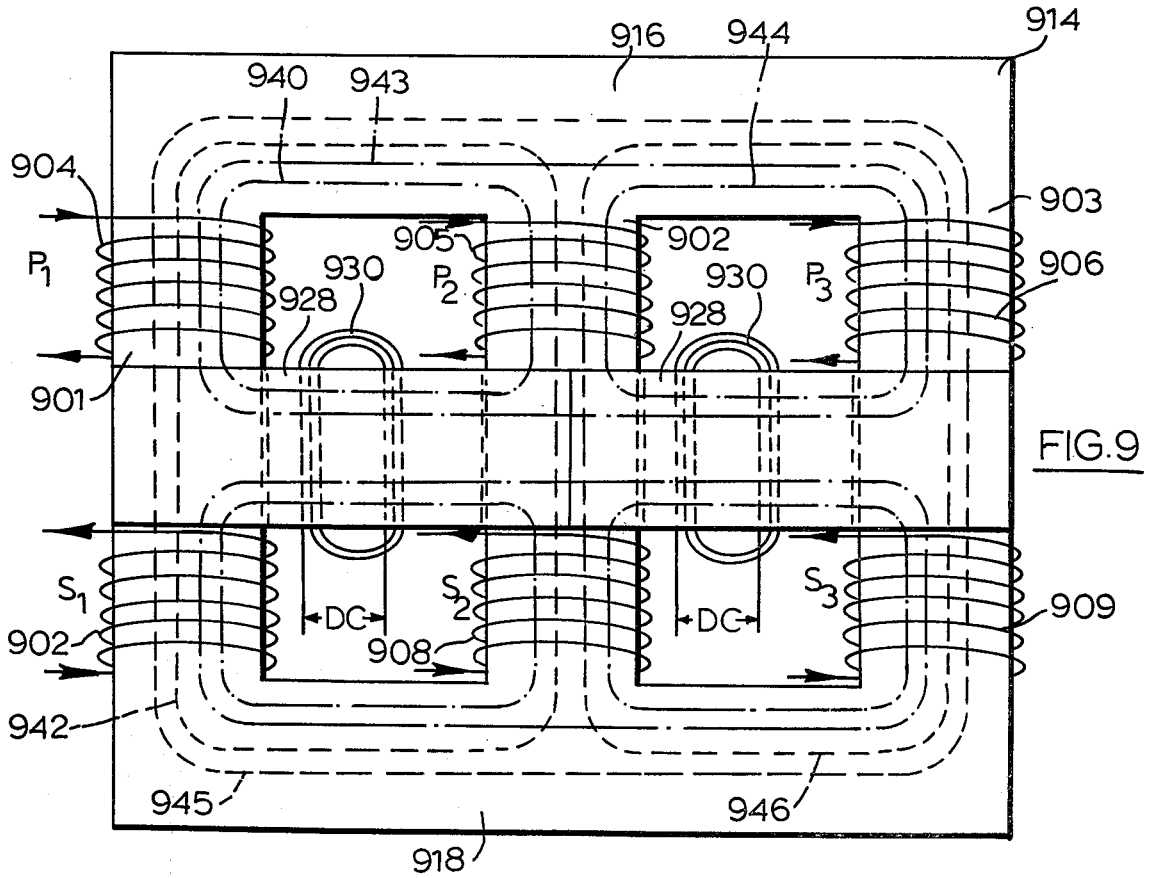
FIG. 9 is a schematic sketch of a typical three-phase arrangement of a regulating power transformer according to this invention.

Finally, reference is made to FIG. 9 which shows a three-phase operation but which can be seen to be readily extended to multi-phase embodiments of the basic regulating power transformer according to this invention. In the embodiment of FIG. 9, there are three core legs 901, 902 and 903 in the lamination stack 914, together with upper and lower portions 916 and 918, respectively. However, in the embodiment of FIG. 9, the cross-sectional areas of each of the core legs 901, 902 and 903 are equal. There are primary windings 904, 905 and 906 placed on the core legs 901, 902 and 903, respectively, and likewise there are secondary windings 907, 908 and 909. A pair of shunt members 928 are placed between the pairs of core legs 901 and 902, and 902 and 903, respectively; and the cross-sectional area of the shunt members 928 are at least as great as the cross-sectional areas of any of the core legs 901, 902 or 903.

The three phases of a three-phase AC system may be imposed on the primary windings 904, 905 and 906, respectively; and in the absence of any DC control current on the DC control windings 930, three flux path loops 940, 943 and 944 are established, as shown by their respective chain lines in FIG. 9. Likewise, at maximum coupling between the primary windings and their respective secondary windings there are three magnetic flux loops 942, 945 and 946 established. Alternative arrangements with respect to split primary windings and split magnetic shunt members, alternative placements of the DC control windings within the shunt members, and so on, are applicable to the circuit arrangement of FIG. 9 as previously discussed. Likewise, the circuit arrangement of FIG. 9 can be extended to multi-phase circuits by the additional core legs and primary and secondary windings, as required.

The advantages of all of the circuit arrangements according to this invention, which are exemplary only and are not limiting, have been discussed above. Likewise, it is clear that alternative arrangements may be made with respect to placement of coils or the shunt members, providing that there is a shunt member interposed between respective primary and secondary windings on any core leg, and provided further that the DC control winding is placed within the shunt member in such a manner as to provide the very wide control range which may be accomplished in regulating power transformers built in accordance with this invention, and having construction which falls within the ambit of the claims appended hereto.

I claim:

1. A regulating power transformer having at least one primary winding and at least one secondary winding which are separated one from the other, and having at least one AC magnetic path through which an AC flux coupling said at least one primary winding to said at least one secondary winding can be established; and having at least one shunt member interposed between said primary and secondary windings, and placed between two portions of said AC magnetic path with an air gap at each end of said shunt member between the ends thereof and the respective contiguous portions of said AC magnetic path;

at least one DC control winding arranged with said shunt member so as to pass through at least one window formed therein;

the sum of the AC reluctance of the shunt member and the AC reluctances of the air gaps at the ends of said shunt member being less than the AC reluctance of that portion of the Ac magnetic path on which said at least one secondary winding is placed; so that, when there is zero current in said DC control winding, there is substantially zero coupling between said primary and secondary windings;

the magnetic circuit for said at least one AC magnetic path having at least two core legs each having substantially uniform cross-section along its length;

said magnetic shunt member having substantially uniform cross-section along its length except where said at least one window is formed, and further having a portion at each end of said shunt member extending past the respective air gap and over at least a portion of at least one side of the respective AC magnetic circuit flux path core leg;

said AC magnetic path core legs and said at least one shunt member each being of laminated construction.

2. The regulating power transformer of claim 1 where the cross-sectional area of said shunt member is at least equal to the cross-sectional area of said core legs of said AC magnetic circuit at a point where a magnetic flux coupling said primary and secondary windings can be established.

3. The regulating power transformer of claim 1 comprising first and second principal AC magnetic circuit core legs, upon each of which a primary and a secondary winding is placed in spaced relationship one from the other; and where said shunt member extends between said first and second core legs, with said air gaps at each end of said magnetic shunt member where it is contiguous to the respective core leg.

4. The regulating power transformer of claim 3 where said DC control winding is placed through two windows formed in said shunt member.

5. The regulating power transformer of claim 4 where the axes of said two windows formed in said magnetic shunt member are parallel to the longitudinal axes of said core legs.

6. The regulating power transformer of claim 3 where said shunt member has a greater cross-sectional area than the cross-sectional area of said AC magnetic flux path core leg at a point where magnetic flux coupling said primary and secondary windings can be established.

7. The regulating power transformer of claim 1 where there are two windows formed in said shunt member, and where the axis of each of said windows is substantially perpendicular to the longitudinal axes of said core legs.

8. The regulating power transformer of claim 1 where there are three substantially parallel core legs in the principal AC magnetic path, so that magnetic flux path loops can be established in adjacent pairs of said core legs; and where there are two shunt members placed in end-to-end relationship one with the other but between adjacent pairs of said core legs, respectively; and where there is at least one DC control winding placed through at least one window formed in each of said shunt members.

9. The regulating power transformer of claim 7 where the centre one of said three substantially parallel core legs has a greater cross-sectional area than either of the other two core legs; and where each of said shunt members has a cross-sectional area, except where said windows are formed, at least as great as the cross-sectional area of either of said outer pair of core legs.

10. The regulating power transformer of claim 8, where there are a primary winding and a secondary winding placed in spaced-apart relationship on the centre one of said core legs, with said shunt members interposed between them.

11. The regulating power transformer of claim 1 where there are two spaced-apart shunt members placed between said core legs; with a pair of windows formed in each of said shunt members, having their axes substantially parallel to the longitudinal axes of said core legs, and a single DC control winding is placed through said windows; there being a secondary winding placed on each of said core legs in the region of each said core leg between the places where said shunt members are contiguous to said core legs, and two primary windings placed on each of said core legs on the side of each of said shunt members remote from said respective secondary windings; so that, when there is zero current in said DC control winding, there is substantially zero coupling between said primary and secondary windings.

12. The regulating power transformer of claim 8 where there are four shunt members placed in two end-to-end arrangements between adjacent pairs of said core legs; a pair of openings formed in each of said shunt members, and a single DC winding placed through adjacent pairs of said shunt members on either side of the centre one of said core legs, with the axes of said windows through which said DC control windings are placed being substantially parallel to the longitudinal axes of said core legs; a single secondary winding placed on the central one of said core legs in the region thereof between the places where said two end-to-end arrangements of said shunt members are contiguous at their respective inner ends to said central core leg; and a pair of primary windings placed on said central core leg on the sides of said end-to-end arrangements of said shunt members which are remote from said secondary winding.

13. The regulating power transformer of claim 1 where there are three substantially parallel core legs, each having substantially equal cross-sectional areas, and at least one shunt member placed between each adjacent pair of core legs; a DC control winding arranged with each said shunt member so as to pass through at least one window formed therein; and at least one primary winding and at least one secondary winding in spaced-apart relationship therewith placed over each of said core legs, each of said primary windings being of a different phase of a three-phase AC article system.

* * * * *